US006347726B1

(12) United States Patent
Jackson et al.

(10) Patent No.: US 6,347,726 B1
(45) **Date of Patent: *Feb. 19, 2002**

(54) DUAL DISPENSE CONTAINER HAVING CLOVERLEAF ORIFICE

(75) Inventors: Douglas J. Jackson, Wayne, NJ (US); Joseph Leboeuf, Bourg-la Reine (FR); Justin E. McDonough, Kenvil, NJ (US)

(73) Assignee: Pechiney Plastic Packaging, Inc., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/724,357

(22) Filed: Nov. 28, 2000

Related U.S. Application Data

(63) Continuation of application No. 09/295,825, filed on Apr. 21, 1999, now Pat. No. 6,257,450.

(51) Int. Cl.[7] ..... B65D 35/22

(52) U.S. Cl. ..... 222/94; 222/183

(58) Field of Search ..... 222/94, 145.3, 222/183

(56) References Cited

U.S. PATENT DOCUMENTS 6,176,395 B1 * 1/2001 Abbott et al. ..... 222/94
6,223,943 B1 * 5/2001 Richmond et al. ..... 222/94

* cited by examiner

*Primary Examiner*—Philippe Derakshani
(74) *Attorney, Agent, or Firm*—Ohlandt, Greeley, Ruggiero & Perle, LLP

(57) ABSTRACT

A dual dispense container, for example, a collapsible dual dispense tube, is provided that has a dual dispense orifice whose shape generally corresponds to a cloverleaf. The cloverleaf-like shape of the dual dispense orifice renders the dual dispense container capable of simultaneously dispensing two products with the same or similar flow characteristics in the same or substantially the same volumes.

25 Claims, 4 Drawing Sheets

DUAL DISPENSE CONTAINER HAVING CLOVERLEAF ORIFICE

This is a continuation, of application Ser. No. 09/295,825, filed Apr. 21, 1999 now U.S. Pat. No. 6,257,450.

BACKGROUND OF THE INVENTION

1. Field of the Invention

This invention relates to dual dispense containers comprised of an outer container and an inner container for separately packaging two products and dispensing them as one stream from the dual dispense container orifice. More particularly, this invention is directed to a dual dispense container whose orifice is generally configured as a cloverleaf.

2. Description of Related Art

Dual dispense containers are known. They are used to package products that are intended to be kept separate in the package and not brought into contact or mixed until after they are dispensed from the orifice of the tube. Examples of such containers are collapsible dual dispense tubes. Examples of such products are dentifrices comprised of two products that have different colors and are to be dispensed with a striped appearance, and dentifrices comprised of a peroxide gel product and sodium bicarbonate paste product that chemically react with each other and are to be mixed after dispensing.

Products packaged in a dual dispense containers are intended to be dispensed in a desired ratio for better appearance in the case of striped products, and for maximum effect upon mixing and/or during use, in the case of reactive products. For the latter, it is usually desired that there be as much inter-product surface contact area as possible upon dispensing to maximize mixing during use.

Heretofore, dual dispense containers with an inner tube neck and body disposed within an outer tube neck and body, have not been suitable for dispensing two products having similar flow characteristics in the same or substantially the same volumes, i.e., in substantially a 1:1 dispense ratio. The problem has been that the inner tube dispense orifice for one product and the outer tube dispense orifice for the other product have had different dispense areas and flow resistances, and the flow channels for the passage of the products through the necks to their orifices have had different product flow surface contact areas and flow resistances. Thus, the two products with similar flow characteristics experience different pressure drops as they flow to and are dispensed from the dual dispense orifice. Accordingly, the products are dispensed in different volumes.

Prior dual dispense containers may be rendered generally suitable for dispensing products with dissimilar flow characteristics at times in substantially equal volumes by properly matching the respective products and their dissimilar flow characteristics with the dissimilar flow resistances of the respective inner and outer containers' flow channels and orifices. Usually, the product with the higher viscosity (thicker, less free-flowing) is packaged in the container having the flow path and orifice with relatively less surface contact area and less flow resistance, and the product with the lower viscosity is packaged in the container with relatively more surface contact area and flow resistance. Typically, the higher viscosity product has been contained in the inner tube because it has a more direct path and less flow resistance to the inner tube orifice, and the lower viscosity product has been contained in the outer tube because it has a tortuous path to and greater flow resistance to the outer tube orifice.

Examples of these prior dual dispense containers are disclosed in U.S. Pat. No. 2,939,610 to Castelli et al, and U.S. Pat. No. 1,699,532 to Hopkins. The Castelli et al patent discloses, in FIGS. 1–8, a collapsible dual dispense tube having a side-by-side dispense orifice. The inner tube neck and orifice are D-shaped and the arcuate surface of the neck engages the annular outer tube neck. The orifice for the product contained in the inner tube is within the "D" of the neck and is smaller than the orifice for the product contained in the outer tube. The product with the higher viscosity is contained in the inner tube and the product with the lower viscosity is contained in the outer tube. Because the D-shaped inner tube neck engages more than half of the outer tube bore, most of the product in the outer tube must undergo significantly greater flow resistance because it must travel a circuitous path from one side of the tube to the other to exit from only one side of the dual tube orifice. Thus, this tube would not be suitable for dispensing products with the same or similar flow characteristics in equal or substantially equal volumes. The D-shaped side-by-side orifice provides a dispense stream with product-to-product contact along one surface, and thus provides minimal opportunity for product mixing. The Castelli et al patent also discloses, in FIGS. 9 and 10, a collapsible dual dispense tube having what is sometimes referred to as a sandwich-type orifice, formed by an annular outer tube throat that engages the end walls of a rectangular inner tube orifice and neck. The sandwich orifice has two opposed, small hemi-spherical outer tube orifice sections, one to either side of a large rectangular inner tube orifice. Although this dual tube sandwich orifice and neck design is an improvement over the D-shaped design because it provides two opposed orifices for the outer tube product, the design still provides significantly greater surface area and flow resistance for the lower viscosity outer tube product than for the inner tube product. Much of the outer tube product must still follow a circuitous flow path to be dispensed from the two opposed outer tube orifices. Thus, this dual dispense tube orifice and neck also is not suitable for dispensing products with the same or similar flow properties in the same or substantially the same volumes. Also, it provides a dispensed stream with product mixing along two surfaces for interproduct mixing.

The Hopkins patent discloses, in FIGS. 9 and 10, a collapsible dual dispense tube having a sandwich-shaped orifice that provides more dispense area for the outer tube product than the sandwich orifice of the Castelli et al patent. The Hopkins patent also discloses, in FIGS. 7 and 8, a collapsible dispensing tube formed by an annular outer tube throat that engages the end walls of a triangular inner tube orifice. This dual dispense tube orifice and neck would not be suitable for dispensing products with similar flow properties in equal or substantially equal volumes because the flow paths and orifices for the respective products do not provide the same or substantially the same product contact surface area or flow resistances. It is believed that the direct and wide flow path for the inner tube product to and through its wide, open-centered triangular orifice has less flow resistance and pressure drop than the path for the outer tube product to and through its segmented orifice. The triangular-shaped dual dispense orifice provides product-to-product contact along three arcuate surfaces for enhanced dispensed product mixing.

It has been found that the problem with prior collapsible dispensing tubes in not being able to dispense paired products with similar flow characteristics in the same or substantially the same volumes has been that the flow path and orifice for the higher viscosity inner tube product have not provided sufficient product flow surface contact area, and hence flow resistance and pressure drop, to be equal or substantially equal to the flow resistance and pressure drop provided by the flow path and orifice for the lower viscosity outer tube product.

It has been found that for the foregoing reason, collapsible dual dispense tubes having D-shaped and sandwich shaped flow paths and orifices with dissimilar flow resistances have been unable to initially dispense products with the same or similar flow characteristics in the same or substantially the same volumes. Such dual dispense tubes have not provided sufficient flow restriction, especially as to the inner tube flow path and orifice for the higher viscosity product, to generate enough pressure drop to initially dispense the products in the same or substantially the same volumes. D-shaped and sandwich shaped orifice dual dispense tubes have also been found to be problematical in that even if, after initial dispense, they commence dispensing in equal or substantially equal volumes, the dispense ratio typically is not maintained over a substantial duration, say from one-half to two-thirds, of the dispense life of the dual dispense tube. The dispense ratio tends to vary significantly over the dispense life of the tube. One reason for this is that with repeated non-uniform squeezings at different locations on the outer tube body wall, and with the consequent contortions of the outer tube body wall, the distribution of product in the outer tube becomes less uniform. This, and the tortuous path that much of the outer tube product must follow to reach the outer tube orifice(s), causes variations in the amount of outer tube product available for dispensing and dispensed. This in turn causes variations in the product dispense ratio which increase over the dispense life of the dual tube. Typically, relatively less outer tube product is dispensed with each squeezing, and eventually more or only inner tube product is dispensed.

It has been found that the solution to the above-mentioned inability of prior dual dispense containers, e.g., collapsible dual dispense tubes, to dispense two products of the same or similar flow characteristics in the same or substantially the same volumes is to employ a dual tube orifice and/or neck design, preferably a dual tube orifice and neck design, that provides more surface contact area and more flow resistance for the internal higher viscosity product, preferably while providing more orifice sections for more direct flow and higher volume dispensing of the lower viscosity outer tube product, to thereby equalize or substantially equalize the flow resistances and therefore the flow and dispense volumes of the inner and outer tube products. The solution is met by providing a dual dispense tube having a dual dispense orifice and preferably also an inner tube neck design that generally corresponds to or is shaped like a cruciform or cloverleaf.

In view of the above, it is an object of this invention to provide an improved dual dispense container that overcomes shortcomings of conventional, including side-by-side and sandwich orifice, dual dispense containers.

It is therefore an object of this invention to provide an improved dual dispense container that is suitable for separately packaging two products having the same or similar flow characteristics, and for simultaneously dispensing the products in the same or substantially the same volumes.

Another object of this invention is to provide an improved dual dispense container that provides the same or similar flow resistance for each of its products in their paths to and through the dual dispense orifice.

It is another object of this invention to provide an improved dual dispense container having an orifice that generally corresponds to a cloverleaf.

It is another object of this invention to provide an improved dual dispense container having an inner tube neck and orifice disposed within a outer tube neck and orifice, wherein the inner tube neck in horizontal cross-section generally corresponds to a cloverleaf.

It is yet another object of this invention to provide an improved dual dispense container that is adapted to equalize product dispense pressure requirements for simultaneously dispensing two products having the same or similar flow characteristics in the same or substantially the same volumes.

It is yet another object of this invention to provide an improved dual dispense container that reduces dual product dispense ratio variation during the dispensing life of the container.

It is yet another object of this invention to provide an improved dual dispense container that simultaneously dispenses its products in substantially the same volumes over a substantial portion of the product dispensing life of the container.

It is still another object of this invention to provide an improved dual dispense container adapted to dispense a stream of products having increased interproduct surface contact area and hence increased interproduct mixability.

BRIEF SUMMARY OF THE INVENTION

This invention is directed to a container for dispensing viscous products, comprising a body for containing a viscous product, and a neck connected to the body and defining an orifice for dispensing a viscous product therethrough, wherein the orifice generally corresponds to a cloverleaf with a central bore and petals that communicate with and are non-diverging as they approach the central bore. The neck preferably is elongated and, in cross section, generally corresponds to a cloverleaf whose petals are non-diverging, preferably converging, as they approach the bore.

This invention is also directed to a dual dispense container, comprising an outer container having a neck defining an outer orifice, an inner container having a neck defining an inner orifice, and means for securing the containers to one another such that the neck of the inner container is disposed within the neck of the outer container and the necks and their orifices together form a dual dispense orifice, wherein the inner container neck and orifice generally correspond to a cloverleaf having a central bore that communicates with four hollow petals centrally joined to each other, there being a recess between each pair of adjacent petals, and wherein the outer container neck encompasses and engages the petals and thereby forms a plurality of sub-orifices, each formed of one of the recesses, the sub-orifices together comprising the outer orifice. Each petal of the dual dispense container preferably has an outer wall and an adjoining pair of side walls, the inner container neck and petals are axially elongated, and the recesses form elongated troughs that, with the outer neck, form passageways that communicate with the interior of the outer container and the sub-orifices of the dual dispense orifice. Preferably, the petals and the interiors of the hollow petals that form the inner orifice are symmetrical. Preferably, the bore is axially elongated, the interiors of the hollow petals form elongated channel portions that communicate with the bore, and with the bore form an inner container channel that communicates with the interior of the inner container and with the inner orifice.

In the dual dispense container of the invention, the outer and inner container necks are adapted such that the total dispense area of the outer orifice and the total dispense area of the inner orifice are substantially the same. The outer and inner container necks provide substantially the same product surface contact area and pressure drops to the products that are to flow therethrough and be dispensed from the respective orifices. The inner and outer container necks and orifices are adapted to simultaneously dispense two viscous products separately packaged in the respective inner and outer containers and having the same or similar viscosities, in the same or substantially the same volumes. In the dual dispense container, each petal has an outer wall and a pair of spaced side walls that adjoin the outer wall and preferably are rectilinear and non-diverging, preferably converging, as they approach the bore of the inner container neck. Preferably, the petals and the portions of the inner orifice which they define, the interior channel portions of the hollow petals, and the passageways and sub-orifices are triangular and have open ends that communicate with the bore. Preferably, the petals and the interiors of the petals are symmetrical. The bore of the inner container neck can be formed by an annular wall comprised of spaced segments of a circle, each segment being concave relative to the bore and communicating with and adjoining the adjacent side walls of an adjacent pair of petals.

In the dual dispense container of the invention, the inner container neck and orifice and the inner container neck below the orifice can in cross section correspond to a cloverleaf having a hollow core that is in communication with at least three hollow petals, each petal having an outer wall and an opposed pair of side walls that preferably are non-diverging as they approach the bore. Preferably, the petals have an arcuate outer wall. When the cloverleaf has three petals that diverge as they approach the bore, the channel preferably has inwardly directed extensions.

DETAILED DESCRIPTION OF THE INVENTION

Figure 1:
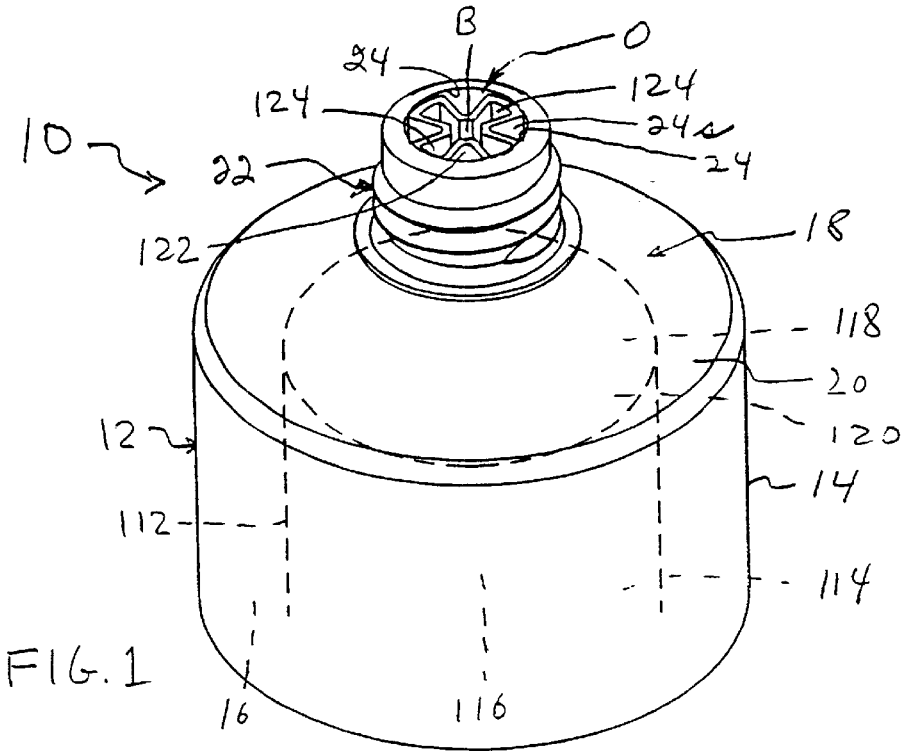
FIG. 1 is a perspective view, with portions broken away, of a preferred collapsible dual dispense container or tube of the invention.
Figure 2:
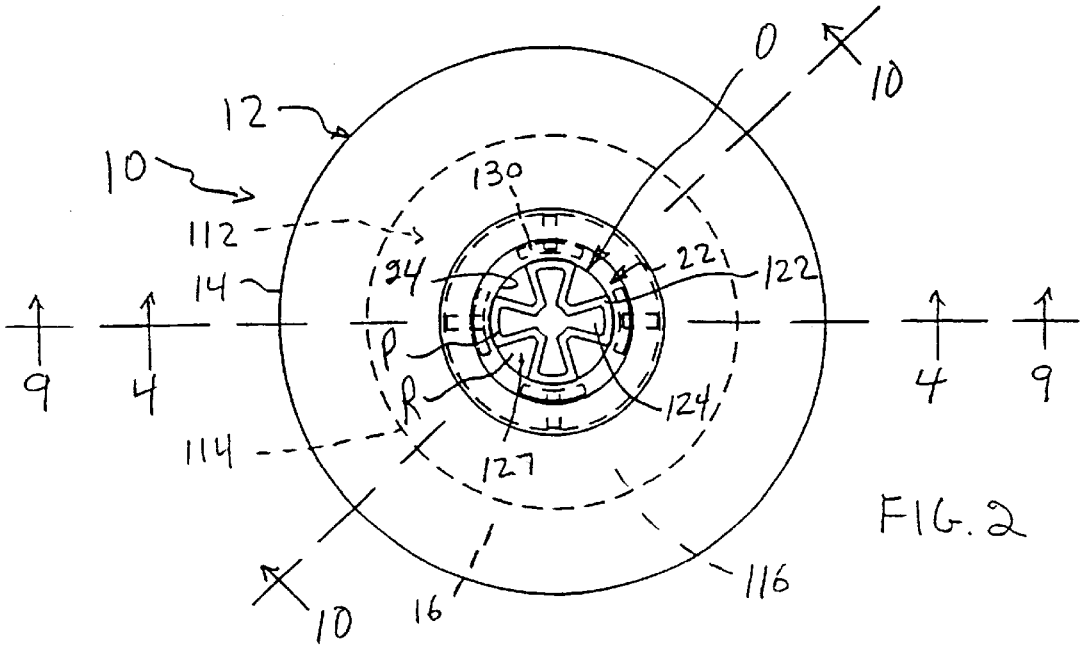
FIG. 2 is a top plan view of the collapsible dispensing tube of FIG. 1.

FIGS. 1 and 2 show a preferred embodiment of a dual dispense container of the invention, here shown as a collapsible dual dispense tube, generally designated 10, comprised of an outer tube 12 and an inner tube 112 (dashed line) secured to or locked within the outer tube. Each tube 12, 112, is comprised of a container body, here shown as a tubular body wall 14, 114, respectively defining a portion of a first chamber 16 and of a second chamber 116. Each tube 12, 112 respectively additionally comprises a head, generally designated 18, 118, which in turn is comprised of a neck 22, 122, and a shoulder 20, 120 to which the respective body wall 14, 114 is joined. Although not shown, each body wall 14, 114 is closed at its bottom by suitable means, as by interfolding and/or sealing the respective body wall to itself. Preferably, the bottom of inner body wall 114 is closed by being interfolded within and/or sealed within the seal of the bottom of outer body wall 14.

Figure 3:
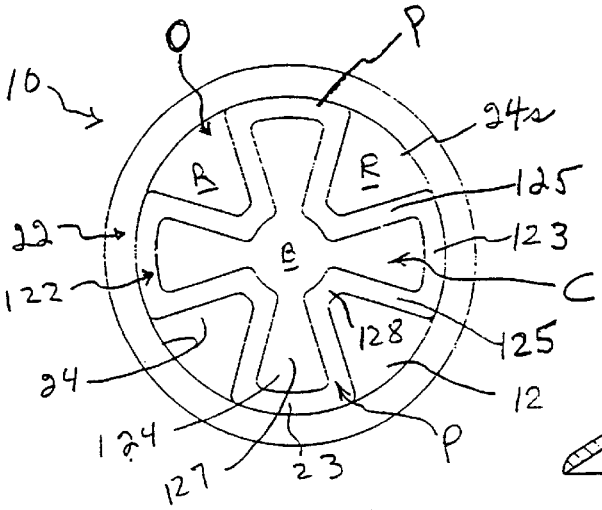
FIG. 3 is a top plan view of only the orifice of the collapsible dispensing tube of FIG. 1.

As also shown in FIG. 3, outer tube neck 22 defines an outer orifice 24, and inner tube neck 122 defines an inner orifice 124. Necks 22, 122 and their orifices 24, 124 together form dual dispense orifice O of dual dispense tube view, generally correspond to a cloverleaf having a central bore B that is a portion of inner orifice 124 and that communicates with at least three, here shown preferably as four centrally-joined, radially outwardly extending hollow petals P. Each petal P is comprised of an arcuate outer wall 123 having circumferentially opposed ends and a pair of spaced side walls 125 that adjoin the opposed ends and converge as they approach bore B. There is a recess R between each pair of adjacent petals P. Outer tube neck 22 encompasses and engages outer walls 123 of petals P and forms a plurality of circumferentially separated outer tube sub-orifices 24*s*, each formed by a recess R. Sub-orifices 24*s* together comprise outer tube orifice 24.

FIGS. 1, 2 and 3 show that annular wall 128 that forms the bore of the cloverleaf-like configuration of inner tube neck 122, is comprised of spaced segments of a circle. Each segment communicates with and adjoins the adjacent side walls 125 of an adjacent pair of petals P. As shown, preferably the radially inside and outside surfaces of wall 128 curve concavely outward relative to bore B.

Figure 4:
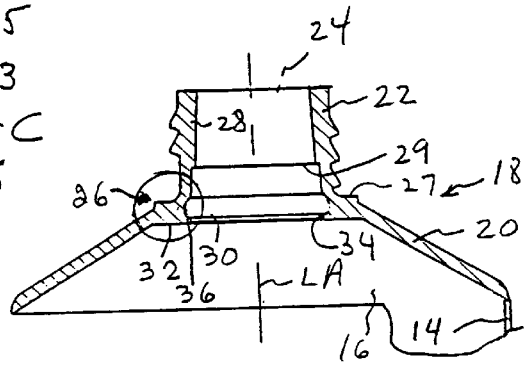
FIG. 4 is a vertical sectional view, with portions broken away, as would be seen through the outer tube, along line 4—4 of FIG. 2.

FIG. 4 shows that outer tube neck 22 has a longitudinal axis LA, a base 26, and a wall with an interior surface defining a cylindrical throat 28 which communicates with outer orifice 24 and chamber 16. Throat 28 is slightly tapered from a wider diameter at base 26 to a narrower diameter adjacent orifice 24. Throat 28 has a slight, annular, radially outwardly and downwardly facing step 29 for engaging a corresponding radially outwardly and upwardly facing step wall 129 (FIGS. 5 and 6) on the outer surface of inner tube 122. The interengagment of these steps provides a seal which prevents product from proceeding further axially upward between outer and inner tube necks 22, 122.

Outer tube neck 22 includes securement means for securing inner and outer tubes 12, 112 to one another. The securement means are here shown as preferably including a groove 30 at, including adjacent or proximate to, base 26 and extending radially outwardly into the interior surface of outer tube neck 22. As also clearly shown in the enlarged view of FIG. 12, the securement means of outer tube neck base 26 preferably also include an undersurface 32, and an interstitial wall 34 between groove 30 and undersurface 32 and which forms part of throat 28. A portion of undersurface 32 communicates with outer tube chamber 16 and extends under a portion of the securement means, here under groove 30. As shown, the securement means of outer tube neck 22 preferably also include a latch 36. Latch 36 is comprised of a portion of neck base 26 and preferably is formed by a lower wall portion 31 of the lower wall which defines groove 30, and by interstitial portion or wall 34 and a portion of base undersurface 32. Base 26 of outer tube neck 22 here is the portion of the head at the junction of the vertical portion of neck 22 and the shoulder 20. Base 26 can include outer tube land 27, and portions of the neck which are adjacent or proximate to the base, such as a short extent of the vertical portion of neck 22, usually below the lowermost thread of a threaded neck. A portion of neck 22 which is considered to be adjacent or proximate to base 26 is located below the mid-point of the axial extent of the neck.

Figure 5:
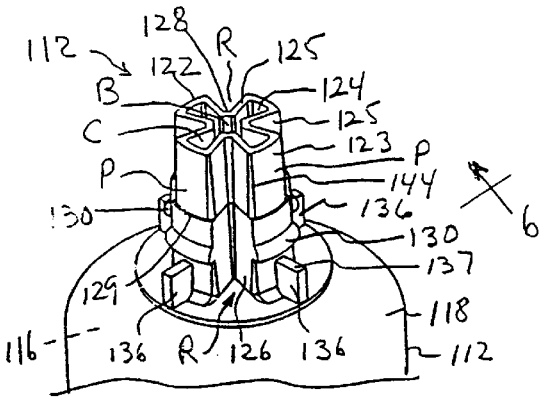
FIG. 5 is a perspective view, with portions broken away, of the inner tube shown in FIG. 1.
Figure 6:
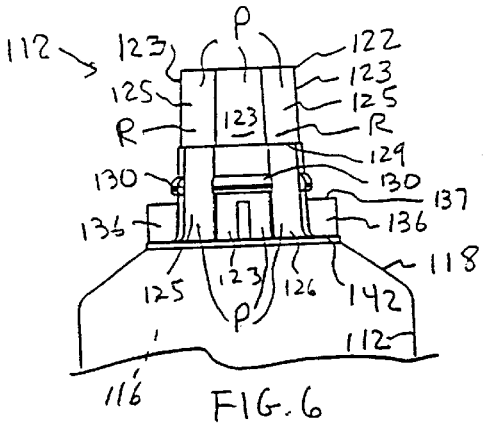
FIG. 6 is a side elevational view, with portions broken away, of the inner tube as it would be seen along line 6—6 of FIG. 5.
Figure 10:
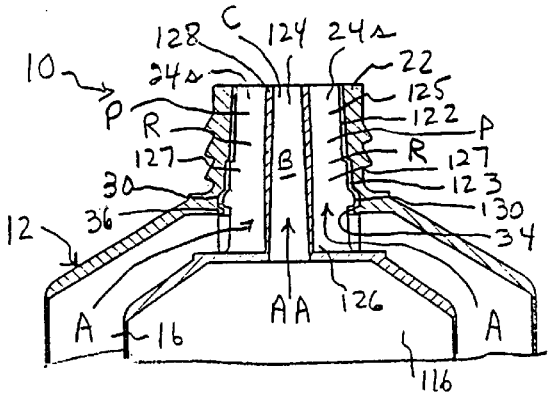
FIG. 10 is a vertical sectional view, with portions broken away, as would be seen along line 10—10 of FIG. 2.

FIGS. 5 and 6 show that inner tube neck 122 and its petals P are axially elongated, and extend from inner orifice 124 to base 126. Recesses R between adjacent pairs of petals P form elongated troughs that, in assembled dual tube 10, form passageways 127 that communicate with sub-orifice 24*s* and chamber 16 of outer tube 12 (FIG. 10). Inner tube neck 122 has an elongated annular wall 128 that forms the core of the cloverleaf and whose interior surface defines axially elongated bore B. Bore B communicates with inner orifice 124 and chamber 116 of inner tuber 112 (FIG. 10). The interiors of hollow petals P form elongated channel portions that communicate with bore B and with it form elongated cloverleaf-shaped inner channel C that communicates with inner orifice 124 and chamber 116.

Figure 7:
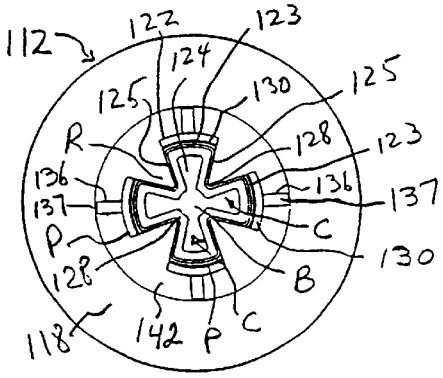
FIG. 7 is a top plan view of the inner tube of FIG. 5.

FIG. 7 is a top plan view of inner tube 112 shown in FIG. 5. FIGS. 5, 6 and 7 show that inner tube 112 has securement means, preferably including an annular bead 130 extending outward from the outer surfaces of outer walls 123 of petals P of inner tube neck 122. Bead 130 is adapted to fit within and be frictionally engaged and entrapped by groove 30 of outer tube neck 22 (FIG. 4). FIGS. 5, 6 and 7 show that inner tube 112 also has locking means, here shown as a plurality of upstanding, rigid ribs 136 disposed about inner tube neck 122. Each rib 136 has an abutment surface 137 that is adapted to abut a portion of undersurface 32 of outer tube neck base 26 (not shown), to thereby assist in securing inner tube 112 to outer tube 12 in a manner to be described. Ribs 136 communicate with and extend from inner tube neck 122 and land 142, and preferably are equally spaced, preferably 90°, from each other about the circumference of inner tube neck 122.

FIGS. 5, 6, and 7 also show that the exterior surfaces of inner tube neck 122 are tapered from their narrower upper portion adjacent orifice 124 to their wider base portions adjacent base 126 and land 142. The upper portion of each outer wall 123 extends about a shorter arc than the lower and base portions of the outer wall. Each outer wall 123 is defined by opposed axial arcuate edges 144 which adjoin side walls 125. As will be explained, the exterior wider, mid-to-lower and base portions of end walls 123 help provide lateral stability to the securement of inner tube 112 within outer tube 12.

Figure 8:
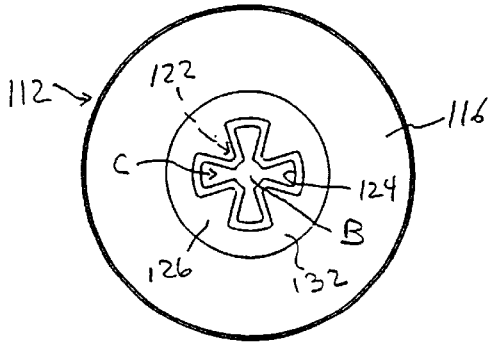
FIG. 8 is a bottom view, with portions broken away, of the base of the inner tube neck shown in FIG. 5.

FIG. 8, a bottom view of the upper portion of the inside of inner tube 112, shows that channel C of inner tube neck 122 is tapered such that inner orifice 124 is smaller than the entrance to channel C in undersurface 132 of base 126 of neck 122 where channel C communicates with chamber 116. FIG. 8 also shows that the generally cloverleaf shape of orifice 124 and of channel C, including bore B, preferably is maintained throughout the axial length of inner tube neck 12, from its orifice 124 to undersurface 132 of its base 126.

Figure 9:
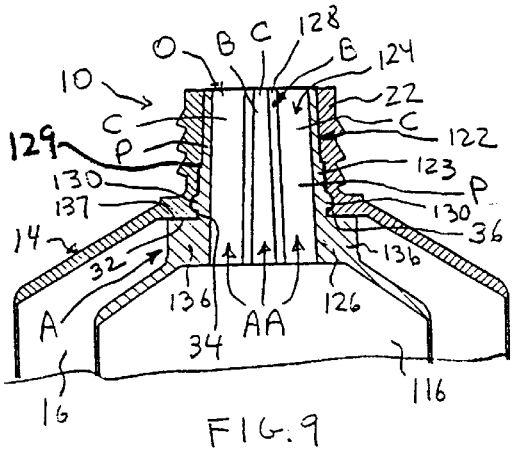
FIG. 9 is a vertical sectional view, with portions broken away, as would be seen along line 9—9 of FIG. 2.

FIG. 9 is a vertical sectional view as would be seen along line 9—9 of FIG. 2 drawn diametrically through opposed petals P of inner tube neck 122 and through outer tube neck 22. FIG. 9 shows that outer tube neck 22 engages outer walls 123 of petals P such that the product does not flow therebetween. Thus, in FIG. 9, when collapsible dispensing tube 10 is filled with products A, AA, and outer tube body wall 14 is squeezed, product A, in outer tube chamber 16, does not flow upward between the engaged portions of outer neck 22 and outer walls 123 of petals P. However, as will be explained in connection with FIG. 10, product A is moved upward between petals P and through passageways 127 to sub-orifices 24*s* (FIG. 10). When outer tube body wall 14 is squeezed, product AA in inner tube chamber 116 is moved directly upward through inner tube elongated channel C, comprised of the interior portion of hollow petals P and bore B, and out of inner orifice 124 of collapsible dispensing tube 10.

FIG. 10 is a vertical sectional view as would be seen along line 10—10 of FIG. 2, diametrically through recesses R between opposed petals P of inner tube neck 122. FIG. 10 shows that when collapsible dispensing tube 10 is squeezed, product A in outer tube chamber 16 is moved upward through elongated recesses R and circumferentially spaced passageways 127 formed by outer tube neck 22, side walls 125 (one shown) of petals P, and core wall 128. Product A exits collapsible dispensing tube 10 through sub-orifices 24*s* of outer tube orifice 24. Product AA in inner tube chamber 116 is moved upward through bore B of channel C and exits inner tube orifice 124.

FIGS. 1–3, 5, 7 and 8 show that, in top plan view, inner tube neck 122 and its orifice 124 generally correspond to a cloverleaf or cruciform. Petals P and the portions of inner orifice 124 and channel C which they define can be any suitable shape. They can be trapezoidal. Preferably, they are triangular in cross section and have open angles or ends that face and communicate with bore B, and outer tube sub-orifices 24*s* likewise preferably are triangular in cross section and have open angles or ends that face and communicate with bore B. These Figures also show that if inner tube neck 122 is viewed in horizontal cross section through petals P between orifice 124 and base 126, inner tube neck 122, petals P and channel C preferably also generally correspond to a cloverleaf or cruciform. From these Figures, it can also be seen that if an assembled dual dispense tube 10 is viewed in horizontal cross section through outer and inner tube necks 22, 122 between orifice O and base 126, passageways 127 preferably are triangular in cross section and have open angles or ends that face and communicate with bore B.

Figure 11:
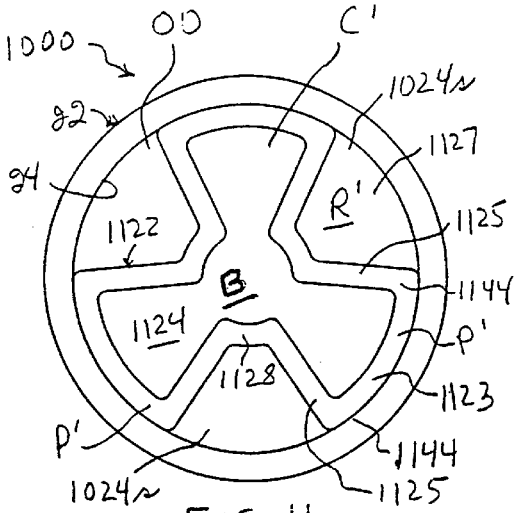
FIG. 11 is a top plan view of only the orifice of an alternate embodiment of a dual dispense container of the invention.

FIG. 11 shows an alternative embodiment of a collapsible dispensing container or tube of the invention, here generally designated 1000. In this embodiment, outer tube neck 22 defines an outer orifice 24, and inner tube neck 1122 defines inner orifice 1124. Necks 22, 1122 and their orifices 24, 1124 together form dual dispense orifice 00. Inner tube neck 1122 and its orifice 1124 generally correspond to a cloverleaf. Orifice 1124 has a central bore B' that communicates with three centrally-joined hollow petals P'. Each petal P' has an arcuate outer wall 1123 with circumferentially opposed ends 1144 and a pair of spaced side walls 1125 that adjoin the opposed ends and preferably converge as they approach bore B'. There is a recess R' between each pair of adjacent petals P'. Outer tube neck 22 encompasses and engages outer walls 1123 of petals P' and forms three outer tube sub-orifices 1024*s*, each formed by a recess R'. Sub-orifices 1024*s* together comprise outer tube orifice 24. Though not shown, except for there being three petals P' in FIG. 11, inner and outer tube necks 22, 1122 are elongated and configured and secured together in the same manner as are outer and inner tube necks 22, 122. Thus, bore B' and the interiors of hollow petals form an elongated generally cloverleaf-shaped channel C' with three petals that communicates with orifice 1124 and the chamber of the inner tube (not shown). Sub-orifices 1024*s* communicate with elongated passageways 1127 that communicate with the chamber of the outer tube (not shown). Inner tube neck 1122 has an annular wall 1128 that forms the core of the cloverleaf and whose interior surface defines bore B'. Annular wall 1128 is comprised of spaced segments of a circle, each segment communicating with and adjoining the adjacent walls 1125 of an adjacent pair of petals P'. Preferably, the inner and outer surfaces of wall 128 are curved concavely outward relative to bore B'. Petals P' and the portions of orifice 1124 and of channel C which they define, and sub-orifices 1024*s* and passageways 1127 are triangular in cross section and have open angles or ends that face and communicate with bore B.

Figure 12:
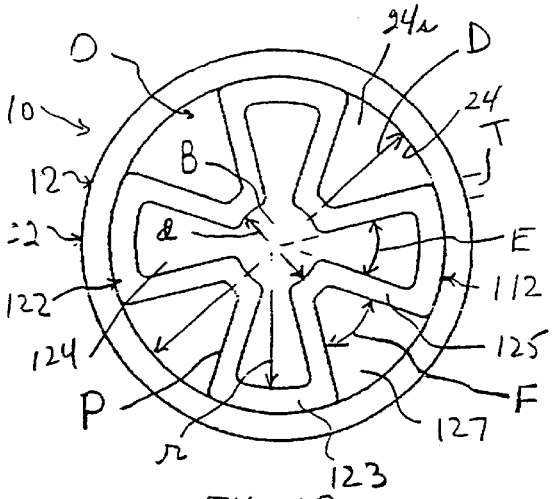
FIG. 12 is another top plan view of only the orifice of the container of FIG. 1.

FIG. 12 shows, with TABLE I below, the preferred approximate dimensions of an outer tube 12 and an inner tube 112 at orifice O of a collapsible dispensing tube 10.

TABLE I

| Feature | Dimensions - inch (metric) area (metric) |
|---|---|
| Outer Tube | 1 5/8 inch × 5 1/32 inch |
| | (41.55mm × 127.8 mm) |
| Diameter D of Orifice 24 (w/o inner tube) | 0.368 inch (9.3 mm) |
| Neck wall thickness | 0.035 inch (.9 mm) |
| Angle F of Passageway 127 | 57 degrees |
| Area of Passageway 127 | 0.000191 $inch^2$ (.12415 $mm^2$) |
| Area (Total) of Passageways 127 (i.e., of Orifice 24) | 0.0344 $inch^2$ (22.36 $mm^2$) |
| Inner Tube | 1 7/64 inch × 5 inch |
| | (28.1 mm × 127 mm) |
| Diameter "d" of bore B | 0.094 inch (2.4 mm) |
| Neck wall Thickness T | 0.025 inch (.6 mm) |
| Angle E between Interior of Side Walls 125 of Petals P | 33 degrees |
| Radius "r" to Interior of End Wall 123 of Petal P | 0.159 inch (4.0 mm) |
| Area of Bore B | 0.00728 $inch^2$ (4.732 $mm^2$) |
| Area of Interior of one Petal P | 0.000636 $inch^2$ (.4134 $mm^2$) |
| Area (Total) of Inner Orifice 124 | 0.0335 $inch^2$ (21.775 $mm^2$) |
| Radius of Wall Intersections (e.g., of walls 123, 125) | 0.010 inch (.3 mm) |
| Orifice O | |
| Area (Total) | 0.067 $inch^2$ (43.55 $mm^2$) |
| Ratio of Dispense Area (Inner/Outer) | 0.994665 |

FIG. 12 and TABLE I show that the dimensions of outer tube 12 and inner tube 112 at orifice O of collapsible dispensing tube 10 are such that the ratio of the total dispense area of inner orifice 124 (0.0335 $inch^2$) (21.775 mm) to that of outer orifice 24 (0.0344 inch) (22.36 $mm^2$) is substantially 1:1. Thus, collapsible dispensing tube 10 is especially adapted to dispense products of the same or similar flow properties, in the same or substantially the same volumes.

Collapsible dual dispensing tubes 10 having a generally cloverleaf shaped orifice as shown in FIGS. 1–10 and having the orifice dimensions shown in TABLE I were manufactured and the dispensability of various paired toothpaste products A and AA, was tested in tubes 10 and in collapsible dual dispense tubes having a side-by-side orifice and neck, and having a sandwich orifice and neck. Two collapsible dual dispense tubes of each of the three tube types were tested for each of three pairs of matched toothpaste products. Each of the tubes tested was comprised of a 15/8 inch (41.6 mm) by 51/32 inch (127.8 mm) outer tube and a 17/64 (inch (28.2 mm) by 5 inch (127.0 mm) inner tube. Each had a body wall made of the same multilayer laminate comprised of plastic layers and a foil layer.

Tubes were filled, sealed and tested. The outer tubes were filled with 57 ml of a product A and the inner tubes were filled with 58 ml of a product AA. Dispensing was of repeated 1 inch (25.4 mm) ribbons of toothpaste product until no more product would dispense. The viscosity of each product of a particular pair of toothpaste products A, AA that was tested in each set of tubes was the same or substantially the same and is shown in TABLE II below.

TABLE II

| Pairs of Toothpaste Products | Relative Viscosity(cps) | Outer Tube Product | Inner Tube Product |
|---|---|---|---|
| 1. | 2.00 MM | A1 | AA1 |
| 2. | 1.00 MM | A2 | AA2 |
| 3. | 0.50 MM | A3 | AA3 |
| 4. | 0.25 MM | A4 | AA4 |

The viscosities of the respective products were measured with a Brookfield Digital Viscometer, Model LVTDV-II, with a Model D Helipath Stand using Spindle T-F. The Viscometer is capable of testing to a maximum viscosity of 2 million (MM) centipoises (cps).

The tests showed that in terms of dispensing dual products in the same or substantially the same volumes, i.e., in approximately 1:1 product dispense ratios, the tubes 10 of the present invention having the cloverleaf orifice and neck were clearly superior to the side-by-side orifice tubes and the sandwich orifice tubes for dispensing the pairs of products having the same or substantially the same relative viscosities ranging from 0.25 MM to 1.00 MM, especially those pairs whose viscosities were 0.50 MM and 1.00 MM. Toothpaste product AA contained in the inner tubes of the dual dispense tubes having the side-by-side and sandwich orifices and necks dispensed at a higher volume than the outer tube products A until the tubes were about half emptied, after which product A in the outer tube dispensed at a higher volume. Products A2, AA2 having relative viscosities of about 1 MM had the best dispensing performance. Products A1, AA1 having relative viscosities of approximately 2.00 MM were difficult to dispense in the tubes having a cloverleaf orifice whose dimensions are shown in TABLE I. It is believed that this was because the design and dimensions of petals P provided excessive flow resistance, particularly at the base of the petals where they joint bore B. Products A4, AA4 with matched viscosities of approximately 0.5 MM did not dispense well, as they were difficult to control because of their low viscosity. Thus, these tests showed that paired toothpaste products with matched viscosities in the range of about 0.50 MM to about 1.00 MM cps dispensed best from collapsible dual dispense tubes having a cloverleaf orifice and neck.

Further tests were conducted using paired toothpaste products having dissimilar viscosities packaged in collapsible dual dispense tubes 10 of the invention having a cloverleaf orifice and neck and whose dimensions are shown in TABLE I, to determine which tubes and products provided the most consistent dispense ratios over the dispense life of the tubes. TABLE below III shows the relative viscosities of the paired toothpaste products tested.

TABLE III

| Pairs of Toothpaste Products | Relative Viscosities (cps) | Outer Tube | Relative Viscosities (cps) | Inner Tube |
|---|---|---|---|---|
| 5. | 1.0 MM | A5 | 2.0 MM | AA5 |
| 6. | 0.5 | A6 | 1.0 MM | AA6 |
| 7. | 0.25 | A7 | 0.5 MM | AA7 |

It was found that tubes 10 of the invention provided the most consistent dispense ratios over the dispense lives of the tubes. In tubes 10, the $6^{th}$ pair of toothpaste products maintained the most consistent dispense ratios and provided easy squeezing and good control over flowability. In tubes 10, the dispense ratio of the $6^{th}$ pair of products was maintained most consistently over approximately ⅔ of the dispense life of the tube, after which inner tube product AA6 dispensed at a higher volume.

Other tests were conducted comparing the initial dispense ratios, and dispense ratio consistency performances of collapsible dual dispense tubes 10 of the invention having a cruciform or cloverleaf orifice and neck of the dimensions shown in TABLE I, with those of collapsible dual dispense tubes having side-by-side and sandwich orifices and necks. In these tests, the tubular bodies of the outer and inner tubes had the same dimensions as in the previous tests. The tubes had multilayer plastic bodies each containing a foil layer. The outer tubes were filled with a gel having a viscosity of about 2 MM (cps) to a target volume of 57 ml and a fill weight of 61.6 grams. The inner tubes were filled with a paste having a viscosity of about 2 MM (cps) to a target volume of 57 ml and fill weight of 79.5 grams. The test results are shown in TABLE IV below.

TABLE IV

| | Tube Orifice Type | Tube Body | Results |
|---|---|---|---|
| 8. | "Side-by-Side" Orifice and Neck | Multi-layer (plastic and foil layers) | Initially dispensed only paste, then gel, then near the end of dispense, more gel than paste |
| 9. | "Sandwich" Orifice and Neck | Multi-layer (plastic and foil layers) | Initially dispensed mostly paste, then more paste than gel, then near the end of dispense, more gel than paste |
| 10. | "Cloverleaf" Orifice and Neck | Multi-layer (plastic and foil layers) | Initially, paste and gel dispensed at substantially equal ratios, then at fairly consistent dispense ratios, until near the end of dispensing when more paste than gel was dispensed. |

When these tests were repeated for collapsible dual dispense tubes having a sandwich orifice and neck, but having outer and inner tube body walls each without a foil layer, dispense ratios were more erratic and there was more product remaining in the dual tubes at the end of the dispensing than in the case of the sandwich orifice tube referred to in TABLE IV whose outer and inner tubes each had a foil layer. Thus, preferred collapsible dual dispense tubes of the invention are those wherein at least one, preferably each, of the inner and outer tube bodies, has at least one layer that is comprised of foil that provide(s) memory or dead-fold properties to the inner and/or outer tubes of the dual tube. If one of the inner and outer tubes is to have greater deadfold properties, preferably it is the outer tube, especially if the product to be dispensed from the outer tube has a lower viscosity than the product to be dispensed from the inner tube.

Figure 13:
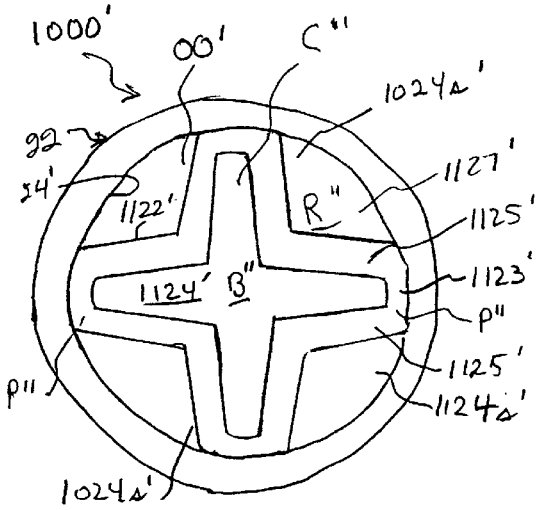
FIG. 13 is a top plan view of only the orifice of another alternative embodiment of a dual dispense container of the invention.

FIG. 13 shows another alternative embodiment of a collapsible dispensing container or tube of the invention, generally designated 1000'. In this embodiment, inner tube neck 1122' defines inner orifice 1124'. Necks 22 and 1122' and their orifices 24', 1124' together form dual dispense orifice 00'. Inner tube neck 1122' and its orifice 1124' generally correspond to a cloverleaf, here shown in the form of a cruciform or star. Orifice 1124' has a central bore B" that communicates with four centrally-joined petals P". Each petal P" has an arcuate outer wall 1123' and a pair of spaced side walls 1125' that diverge as they approach bore B". There is a recess R" between each pair of adjacent petals P". Outer tube neck 22 encompasses and engages outer walls 1123' and forms four outer tube sub-orifices 1024*s*' each formed by a recess R". Sub-orifices 1124*s*' together comprise outer tube orifice 24'. Though not shown in FIG. 13, except for being configured as a cruciform or star, inner and outer tube necks 22, 1122' preferably are elongated and configured and secured together as are outer and inner tube necks 22, 1122'. Thus, bore B" and the interiors of petals P" form cruciform or star-shaped channel C" that communicates with orifice 1124' and the inner tube chamber (not shown). Sub-orifices 1024*s*' communicate with elongated passageways 1127' that in turn communicate with the outer tube chamber (not shown).

Figure 14:
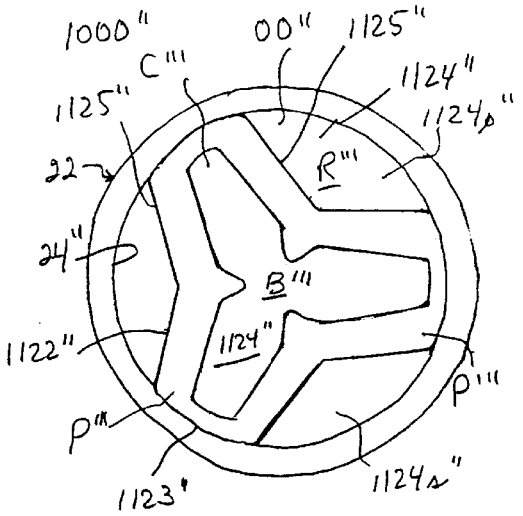
FIG. 14 is a top plan view of only the orifice of another alternative embodiment of a dual dispense container of the invention.

FIG. 14 shows another embodiment of a collapsible dispensing container or tube of the invention, generally designated 1000" having an inner tube neck 1122" that defines inner orifice 1124". Necks 22 and 1122" and their orifices 24", 1124" together form dual dispense orifice 00". Inner tube neck 1122" and its orifice 1124" generally correspond to a three petaled star or triangle. Orifice 1124" has a central bore B" that communicates with three centrally-joined petals P"', each having an arcuate outer wall 1123" and a pair of spaced side walls 1125" that diverge as they approach bore B"'. Outer tube neck 22 engages outer walls 1123" and forms of recess R"', three outer tube sub-orifices 1124*s*" which together comprise outer tube orifice 24". Except for being configured with three petals, inner and outer tube necks preferably are elongated and configured and secured as are outer and inner tube necks 22, 1122'. As in the embodiments of FIGS. 11 and 13, dual dispense container 1000", has a star or triangle-shaped channel C'" and passageways 1127".

The dual dispense containers of the invention having an orifice and neck that generally correspond to a cloverleaf overcome the shortcomings of the prior art and meet the objectives of the invention. The cloverleaf-like shape of the inner container orifice and neck provides at least three petals that provide at least three interior channel portions and preferably an equal number of outer container sub-orifices. The cloverleaf-like shape of the inner container neck and orifice render the dual dispense containers especially adapted for dispensing products having the same or similar flow characteristics in the same or substantially the same volumes. More particularly, the dual dispense tubes of the invention are adapted to dispense a dual product comprised of a product A, contained in the outer tube and having a lower viscosity, through outer tube passageways 127 and sub-orifices 24*s* which present a certain first surface flow resistance and impart a certain first pressure drop, together with a product AA, contained in the inner tube and having a higher viscosity, through channel C which presents a second surface flow resistance and pressure drop, where the first and second flow resistances and pressure drops are substantially the same, such that products A and AA can be simultaneously dispensed in the same or substantially the same volumes.

The cloverleaf-like configuration of the inner tube neck and orifice provide three, four, or more petals and inner tube product flow path or channel and orifice sections or portions that provide the increased product flow contact surface area and consequent flow resistance and pressure drop necessary to equalize or substantially equalize the flow resistance and pressure drop provided by the outer tube product flow paths or passageways and sub-orifices. The cloverleaf-like configuration also allows for the provision of increased outer tube orifice sections, e.g., four outer tube sub-orifices (for an inner tube neck having a cloverleaf shape with four petals), one orifice section in each quadrant of the dual dispense tube. This permits more outer tube product to travel directly rather than circuitously, to an outer tube orifice section. It also increases the availability of outer tube product for dispensing, reduces dispense ratio variation during the dispensing life of the dual dispense tube, permits uniform dispense ratios to the maintained over a substantial portion of the product dispensing life of the tube, and results in less outer tube product remaining undispensed in the dual tube at the end of dispensing. The ability to provide the same number, e.g., four, orifice portions or sections for each of the inner and outer tube products helps to equalize dispense pressure requirements for dispensing the products in approximately a 1:1 ratio.

The three, four or more petals of the cloverleaf-like shaped inner tube orifice and/or neck, and/or the channel portions which they define, can be of any suitable configuration, shape or dimension, given the flow characteristics desired for the flow properties of the products to be dispensed and the dispense ratios desired. For example, the petals and preferably also their interior portions defining channel C can generally correspond to the petals or leafs of a conventional cloverleaf or of a cruciform, or to the petals, e.g., the extensions or points of a star or a triangle. The petals and preferably also their interior portions defining channel C preferably are symmetrical. The side walls of the petals preferably are rectilinear, although they can be curved, preferably concavely outwardly from the longitudinal axis of the petal. In order to provide increased flow resistance to the inner tube product, preferably the side walls of each petal are non-diverging, more preferably converging, relative to each other as they approach bore B or the core at the central area of the cloverleaf. When the side walls of the petals diverge as they approach bore B, preferably the interior surface(s) of channel C, e.g., of the petals, and/or of wall 128 have inwardly directed members or extensions that extend into channel C to provide increased product surface contact area and increased pressure drop for the product that is to flow through the channel. Wall 128 that defines bore B can be a continuous uninterrupted wall, although preferably, as shown, it is segmented so that the interiors of the petals communicate with bore B. If wall 128 is an uninterrupted annular wall, the bore can be in its center. The portions of wall 128 at the junction of adjacent side walls 125 of adjacent pairs of petals can be rectilinear, curved or angular.

The cloverleaf-like configuration of the inner tube orifice and/or neck is advantageous because it provides an increased number of inner product flow channel sections and of outer product flow passageways and sub-orifices than heretofore known. The configuration facilitates modification of the designs to suit particular applications because it provides many varied geometrical possibilities for creating, increasing and equalizing product flow surface contact areas and flow resistances of inner and outer tube structure for establishing and equalizing pressure drops of inner and outer tube products. These advantageous aspects render the cloverleaf-like configuration suitable for packaging and dispensing paired products having similar or dissimilar flow characteristics in equal or any desired volumes.

Figure 15:
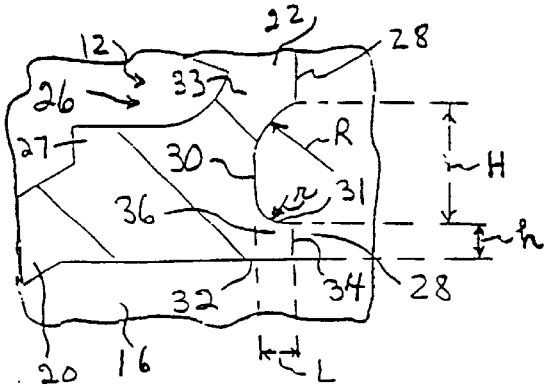
FIG. 15 is an enlarged view of the encircled portion shown in FIG. 4.

FIGS. 9 and 10, with FIG. 15, show the manner in which inner tube neck 122 is disposed and locked within outer tube neck 22. FIGS. 9 and 10 show that the outer surfaces of inner tube neck end walls 123, including radially outwardly extending step wall 129, are frictionally engaged with the juxtaposed portions of outer tube neck bore 28. Bead 130 of each opposed end wall 123 is frictionally engaged with groove 30 in outer tube neck base 26, and the portion of each end wall 123 directly below bead 130 is frictionally engaged with outer tube interstitial wall 34. "Frictionally engaged" here preferably means that there is from zero to about a 0.002 (0.508 mm) or 0.003 inch (0.076 mm) tolerance or gap between the outer surface of inner tube end walls 123, including bead 130, and the inner surfaces of outer tube bore 28, groove 30 and interstitial wall 34. FIG. 9 also shows that upper surfaces 137 of opposed inner tube ribs 136 abut a portion of outer tube neck base undersurface 32 which underlies bead 130 in groove 30 to thereby pinch and lock interstitial wall 34 firmly between rib upper surfaces 137 and bead 130. This abutment forces latch 36 against bead 130 and holds latch 36 firmly between rib surfaces 137 and bead 130 and firmly against bead 130. This causes latch 36 to latch and firmly lock bead 130 in groove 30. Thus, in the preferred embodiment of dual dispense tube 10, the securement means of outer tube 12, including groove 30, interstitial wall 34, latch 36 and undersurface 32, and the securement means of inner tube 112, including bead 130 and the locking means, comprised of ribs 136, cooperate to lock inner tube 112 axially and laterally within outer tube 12. It is to be noted that FIG. 10 shows a slight gap between petal outer wall 123 and outer tube neck throat 28 because the cross-section of FIG. 10 is taken circumferentially forward (towards the reader) of where outer wall 123 and bead 130 frictionally engages throat 28 and groove 30.

Also, it is to be understood that it is within the scope of this invention that inner tube neck 122 can be locked within outer tube neck 22 by the aforesaid abutment and latching mechanism, without frictional engagement of, and/or without pinching and locking of, an interstitial wall.

FIG. 13, an enlarged view with portions broken away, of the encircled portion of FIG. 4, shows that groove 30 extends in a direction radially outward from longitudinal axis LA of outer tube 12 (FIG. 3) and into the outer tube neck interior surface which forms bore 28. FIG. 12 shows that groove 30 has, and is defined in part by, a lower wall portion 31 which also forms the upper portion of latch 36. Latch 36 is here shown in the form of a lip, and is formed by a portion of outer tube neck base 26, lower wall portion 31, interstitial wall 34 and a portion of outer tube neck base undersurface 32. As shown, preferably, interstitial wall 34 forms part of bore 28 and is located between the lower edge defining groove 30 and the radially inward edge of undersurface 32. Preferably, the radially inward edge is chamfered.

As shown in FIG. 13, groove 30 has an axial height H, and interstitial wall 34 of latch 36 has an axial height h. It is understood that height h can equal or approximately height H. However, preferably, interstitial wall axial height h is less than groove axial height H. More preferably it is less than ½, and most preferably it is about ¼ to about ⅓ of groove axial height h. It has been found that when outer and inner tube necks 22, 122 are made of a polyethylene material such as a high density polyethylene, inner tube neck 122 can be locked firmly within outer tube neck 22 by employing an outer tube groove 30 having an axial height H of about 0.064 inch (1.626 mm) and an outer tube interstitial wall 34 whose axial height h is about 0.190 inch (0.483 mm). These heights, particularly axial height h, can vary depending on the polymeric materials employed and their physical characteristics, particularly their flexibility. Thus, for some outer tube neck materials which are quite flexible, relatively deformable and elastically recoverable, axial height h could equal or possibly even exceed axial height H. For outer tube neck materials which are more rigid and less deformable and elastically recoverable, the axial height h may be less than ¼ of groove axial H.

FIG. 13 shows that groove 30 preferably is formed in part by two curved surfaces, an upper curved surface formed by a radius R, and a lower curved surface formed by a radius r. Preferably, radius r is shorter than radius R. It will be understood that the outer surface of convexly shaped bead 130 is formed with basically the same radii as employed for groove 30. The greater radius B of the upper curved surface of bead 130 allows bead 130 to slip easily past interstitial wall 34 if these surfaces come into contact during assembly of dual dispense tube 10, when inner tube neck 122 is pushed up into outer tube neck 12. The dimensions of the inner tube neck and outer tube neck are adapted such that when bead 130 is seated within groove 30, ribs 136 abut a portion of outer tube neck undersurface 32. Inner tube 112 is thereby prevented from being inserted further into outer tube 12, without need of any aforementioned problematical prior radially inwardly directed stopping flange at the orifice of outer tube orifice 24. The shorter radius r forming the lower arcuate surface of bead 130 and of groove lower wall portion 31, and the short horizontal straight portion of bead 130 which runs to inner tube end wall 123 below the bead, and of lower wall 31 which runs to the edge of groove 30 and bore 28, as well as the immobility of latch 36 which is abuttingly pinched and locked by ribs 136 against bead 130, cooperate to prevent bead 130 from being dislodged axially downward from groove 30 when an axially downward force is exerted on the rim of the inner tube neck 122. It has been found that preferred dimensions for groove 30 include an upper curved surface radius B of about 0.040 inch (1.016 mm), a lower curved surface radius r of about 0.015 inch (0.381 mm), and a groove radial depth and consequently a latch radial length L of about 0.018 inch (0.457 mm). As previously stated, the interstitial wall axial height is about 0.019 inch (1.483 mm). The chamfered edge adjoining undersurface 32 and interstitial wall 34 can be formed by a radius of about 0.005 inch (0.127 mm). Preferably, the physical and other characteristics and dimensions of base 26 and/or of latch 36 are chosen and/or adapted to enable latch 36 to flex and deflect downward and radially outward when outer tube neck 22 is disassociated from the injection mold tooling on which the neck is formed, and to be forced radially inward and upward by locking means to latch, entrap and lock bead 130 in groove 30. Although some flexibility and deflection of latch 36 can be obtained by design of some flexibility in or some flexing of inner tube neck base connecting wall 33, most of the flexing or deflection is of latch 36 itself.

When dual dispense tube 10 is assembled, axial downward movement of inner tube 112 relative to outer tube 12 is prevented as described above. Lateral movement of inner tube 112 within outer tube 12 is prevented by one or more of a number of features, including mainly that outer walls of petals P engage throat 28 of outer tube neck 22 and that upper surfaces 137 of inner tube ribs 136 directly abut against outer tube neck base undersurface 32. Also, the surface portions of ribs 136 and of undersurface 32 which abut each other, preferably are in the same or corresponding planes, which planes preferably are parallel and at an angle which is equal to or less than 90° relative to the longitudinal central axis LA of outer tube neck 22. Further, the abutting surfaces portions of ribs 136 and of undersurface 32 abut along a length or extent sufficient to provide lateral stability of inner tube 112 within outer tube 12. Still further, the plurality of at least three, preferably four, ribs 136 are spaced from each other about inner tube neck 122 a sufficient, preferably equal distance to prevent inner tube 112 from rocking or moving laterally within outer tube neck 22. Yet further, the lower portions of inner tube outer walls 123 are broader than their upper portions, and the lower portions of end walls 123 and bead 130 extend through an arc which is greater than 180° about inner tube neck 122.

An important aspect of the preferred securement means, is the flexibility or deflectability of latch 36. For a given material, this preferably is provided primarily by the design, and selection of the characteristics and dimensions of latch 36 itself, and secondarily, if at all, of adjacent portions of base portion 26 of outer tube neck 22. Thus, as shown, latch 36 preferably is primarily designed to flex, deflect, pivot or be displaced radially outward and downward from or about what can be considered a hinge point adjacent a curved portion of lower wall 31 of groove 30, and secondarily, to a lesser extent, if at all, from or about neck base connecting wall portion 33 (FIG. 12). In the embodiments shown, base wall connecting portion 33 is annular, is tapered radially inwardly and upwardly, and has concave outer and inner surfaces which form a thinned region therebetween which may provide an area for minor movement or displacement of outer tube neck base 26 and t therefore of latch 36.

It is to be understood that latch 36 need not be an integral or singular member. For example, it can be split, for example by a horizontal radially outwardly extending cut, or its function can be provided by separate cooperative members. Also, latch 36 need not be or have a surface which is contiguous with lower wall surface 31 of groove 30. Thus, there can be a member or portion of base 26 between the displaceable latch and groove 30 or bead 130, and there can be plural latches or members which cooperate with one another to achieve the desired latching function. Further, interstitial wall 34 need not be an annular or axial surface. It can have any suitable configuration, shape, or dimension. Also, interstitial wall 34 need not frictionally engage the juxtaposed portion of end wall 140 which is below bead 130, and it need not form part of or be aligned with slightly tapered (about 30) outer tube neck bore 28. Thus, latch 36 can be a radially short member such that it extends under only a portion of groove 30 or bead 130, so long as when it is abutted, it functions as a latch to lock bead 130 in groove 30.

It is also to be understood that outer tube neck base undersurface 32 need not be part of latch 36. The portion of undersurface 32 which is abutted by ribs 136 can be a single surface in one plane, or several surfaces in several planes, and it or they can be of any suitable configuration, shape or dimension, e.g. angled, undulating, stepped, etc. The same applies to the abutting upper surface(s) 137 of ribs 136. Although more than the preferred four ribs can be employed, four equally spaced ribs as described above render latch 36 effective in preventing canting of inner tube 112 and in abutting and latching latch 36, while also avoiding any interference with product flow in any passageway 127.

In the preferred embodiment of dual dispense tube 10, outer tube groove 30 preferably is annular and continuous about outer tube bore 28, as this permits the use of a discontinuous bead 130 or protrusion and obviates need for orientation between the bead or protrusion and groove. Preferably, the groove/bead or protrusion interlock or similar functioning members cover a total of at least 180° thereabout, so as to provide stability to the securement and to prevent rocking of the inner tube neck within the outer tube neck. Although bead 130 and groove 30 can be annular and continuous, such is not preferred because it requires complicated designs and manufacturing equipment to create passageways for flow of product A contained in outer tube 12 radially inwardly or outwardly of the continuous annular bead and groove. The bead and groove can be of any suitable configuration, shape or dimension.

The collapsible dual dispense container of this invention can be made of any material(s) suitable for making such containers. Such materials are known to persons skilled in the art. The tubular bodies of the containers can be comprised of one or more plastic or metal layers or combinations of the same. Preferred materials for forming outer tube heads having a flexible latch 36 include thermoplastics, such as ethylene polymers, including high and medium density polyethylenes, ethylene copolymers, propylene polymers, including polypropylene, propylene copolymers, and blends and ethylene and propylene polymers and copolymers.

The dual dispense container of this invention can be made by methods and tooling known to those skilled in the art. For example, with respect to the manufacture of a collapsible dual dispense tube, first a tubular body can be formed by extrusion of a single layer of plastic material for forming a single layer plastic tube, or by lamination or coextrusion of a multiple layer film which is formed into a tubular body. The tubular body can be placed on appropriate tooling and a head, for example, a pre-formed compression or injection molded head, can be joined to the tubular body. Alternatively, the tubular body can be placed in injection mold tooling wherein a tube head is axially injection molded and thermally joined at its shoulder to the tubular body. These procedures can be employed to separately form inner tube 12 and outer tube 112 of the invention. The tube heads are injection molded with tooling adapted to provide the preferred securement means at the locations as described above. With injection mold tooling which forms the groove in the outer tube neck base and which is withdrawn axially downward from the outer tube neck, during the withdrawal, the latch is moved or is pivoted radially outward to an open latch position. The dual dispense tube is assembled by inserting the inner tube neck within the outer tube neck with the bead of the inner tube neck passing axially by without contacting or slightly contacting but not shearing the open latch of the outer tube neck. The inner tube neck is inserted into the outer tube neck until the bead is seated in the groove of the latter and the locking means of the former abut the undersurface of the outer tube neck base. This moves the latch radially upward and inward and latches and locks the bead of the inner tube within the groove of the outer tube. The assembled tube is then capped using conventional capping methods. After the inner tube and outer tube are simultaneously or serially conventionally filled with product, the open bottom ends of the tubes are conventionally sealed individually or together.

The present invention having thus been described with particular reference to the preferred embodiments and aspects thereof, it will be understood that various changes and modifications may be made therein without departing from the spirit and scope of the invention, as defined in the appended claims.

What is claimed is:

1. A dual dispense container for dispensing first and second viscous products, comprising an outer container for containing the first product, an inner container disposed within the outer container for containing the second product, and a dual dispense orifice for dispensing the first and second products, the dual dispense orifice being comprised of an inner orifice that is in communication with the inner container and an outer orifice that is in communication with the outer container, wherein the inner orifice generally corresponds to a cloverleaf and has a hollow central portion that communicates with four hollow petals, and the outer orifice is comprised of a plurality of sections disposed between the petals of the inner orifice.

2. The dual dispense container of claim 1, wherein the petals are non-diverging as they approach the hollow central portion.

3. The dual dispense container of claim 1, wherein the petals are converge as they approach the hollow central portion.

4. The dual dispense container of claim 1, wherein the inner and outer orifices are adapted to keep the products separate until they are dispensed from the dual dispense orifice.

5. The dual dispense container of claim 1 wherein the inner and outer containers are elongated tubes, each having a flexible body wall.

6. The dual dispense container of claim 1 wherein the longitudinal axes of the inner and outer containers are coaxial.

7. The dual dispense container of claim 1, wherein the ratio of the total dispense area of the inner orifice to that of the outer orifice is substantially 1:1.

8. The dual dispense container of claim 1, wherein the dual dispense container includes flow channels for separately channeling the first and second products to the dual dispense orifice.

9. The dual dispense container of claim 8, wherein the respective channels and orifices for the respective products provide the same or similar flow resistances for each of the products in their paths to and through the dual dispense orifice.

10. The dual dispense container of claim 8, wherein the respective channels for the respective products provide the same or similar product surface contact areas and pressure drops to the respective products that are to flow therethrough and be dispensed from the their respective orifices.

11. A dual dispense container for dispensing first and second viscous products, comprising an outer container for containing the first product, an inner container disposed within the outer container, for containing the second product, and a dual dispense orifice for dispensing the first and second products, the dual dispense orifice being comprised of an inner orifice that is in communication with the inner container and an outer orifice that is in communication with the outer container, wherein the inner orifice generally corresponds to a cloverleaf and has a hollow central bore that communicates with at least three non-diverging hollow petals, and the outer orifice is comprised of a plurality of sub-orifices disposed between the petals of the inner orifice.

12. The dual dispense container of claim 11, wherein the petals are non-diverging as they approach the bore.

13. The dual dispense container of claim 11, wherein the petals are converge as they approach the bore.

14. The dual dispense container of claim 11, wherein the inner and outer orifices are adapted to keep the products separate until they are dispensed from the dual dispense orifice.

15. The dual dispense container of claim 11, wherein the inner and outer containers are elongated tubes, each having a flexible body wall.

16. The dual dispense container of claim 11, wherein the longitudinal axes of the inner and outer containers are coaxial.

17. The dual dispense container of claim 11, wherein the ratio of the total dispense area of the inner orifice to that of the outer orifice is substantially 1:1.

18. The dual dispense container of claim 11, wherein the dual dispense container includes flow channels for separately channeling the first and second products to the dual dispense orifice.

19. The dual dispense container of claim 18, wherein the respective channels and orifices for the respective products provide the same or similar flow resistances for each of the products in their paths to and through the dual dispense orifice.

20. The dual dispense container of claim 18, wherein the respective channels for the respective products provide the same or similar product surface contact areas and pressure drops to the respective products that are to flow therethrough and be dispensed from their respective orifices.

21. A dual dispense container for separately containing two different products having the same or similar flow dispense properties, and for simultaneously dispensing the products in the same or substantially the same volumes, comprising an outer container for containing a first product, an inner container disposed within the outer container, for containing a second product that is different from but has the same or similar viscosity as the first product, a dual dispense orifice comprised of an inner orifice that is in communication with the inner container and an outer orifice that is in communication with the outer container, wherein the inner orifice generally corresponds to a cloverleaf and has a central hollow portion that is in communication with a plurality of hollow petals, and the outer orifice is comprised of a plurality of sub-orifices that are disposed between the petals, for simultaneously dispensing the first and second products from the dual dispense orifice, and flow channels for channeling each of the first and second products separately to their respective orifices of the dual dispense orifice, the separate flow channels having product flow surface contact areas that provide the same or similar pressure drops and flow resistance for each of the products in their respective paths to and through the dual dispense orifice.

22. The dual dispense container of claim 21, wherein the petals are non-diverging as they approach the bore.

23. The dual dispense container of claim 21, wherein the petals converge as they approach the bore.

24. The dual dispense container of claim 21, wherein the inner orifice and the outer orifice have product flow surface contact areas that provide the same or similar pressure drops and flow resistance for each of the products in their respective paths through the dual dispense orifice.

25. The dual dispense container of claim 21, wherein the ratio of the total dispense area of the inner orifice to that of the outer orifice is substantially 1:1.

* * * * *